US005894733A

United States Patent [19]

Brodner

[11] Patent Number: 5,894,733

[45] Date of Patent: Apr. 20, 1999

[54] CRYOGENIC SPECIMEN CONTAINER AND LABELED SLEEVE COMBINATION AND METHOD OF USING SAME

[76] Inventor: John R. Brodner, 426 Hillside Ave., Glen Ellyn, Ill. 60137

[21] Appl. No.: 09/003,912

[22] Filed: Jan. 7, 1998

[51] Int. Cl.[6] ..... F25B 19/00; F25D 17/02

[52] U.S. Cl. ..... 62/51.1; 62/64; 62/457.9

[58] Field of Search ..... 62/51.1, 64, 78, 62/457.9

[56] References Cited

U.S. PATENT DOCUMENTS 3,707,079 12/1972 Hawker ..... 62/64
3,864,927 2/1975 Li .
4,314,450 2/1982 Pelloux-Gervais ..... 62/78 X
4,785,953 11/1988 Buchholz et al. .
5,321,955 6/1994 Leonard .
5,392,943 2/1995 Delatte et al. ..... 62/64 X
5,419,143 5/1995 Leonard et al. ..... 62/51.1 X
5,427,743 6/1995 Markin .
5,545,562 8/1996 Cassou et al. .

*Primary Examiner*—Christopher B. Kilner
*Attorney, Agent, or Firm*—Meroni & Meroni

[57] ABSTRACT

A sleeve structure and method are provided for use with a cryogenic specimen container which is maintained at a cryogenic temperature below −80° C. to allow for labeling of the specimen container. The sleeve structure includes sidewalls defining a cylindrically shaped interior chamber sized for telescopically receiving a lower portion of a cryogenic specimen container in nested engagement. The sleeve structure has a locking mechanism for holding the sleeve structure in removably secured engagement with specimen container when the specimen container is in nested engagement with the sleeve structure. Identification markings are secured to an exterior side of the sleeve structure.

20 Claims, 4 Drawing Sheets

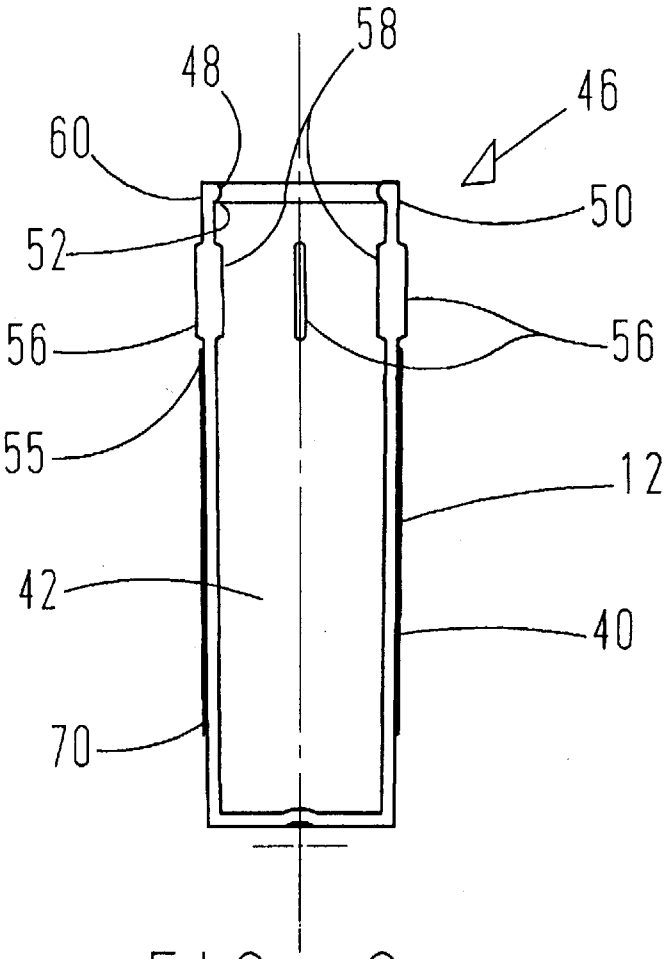
FIG. 2
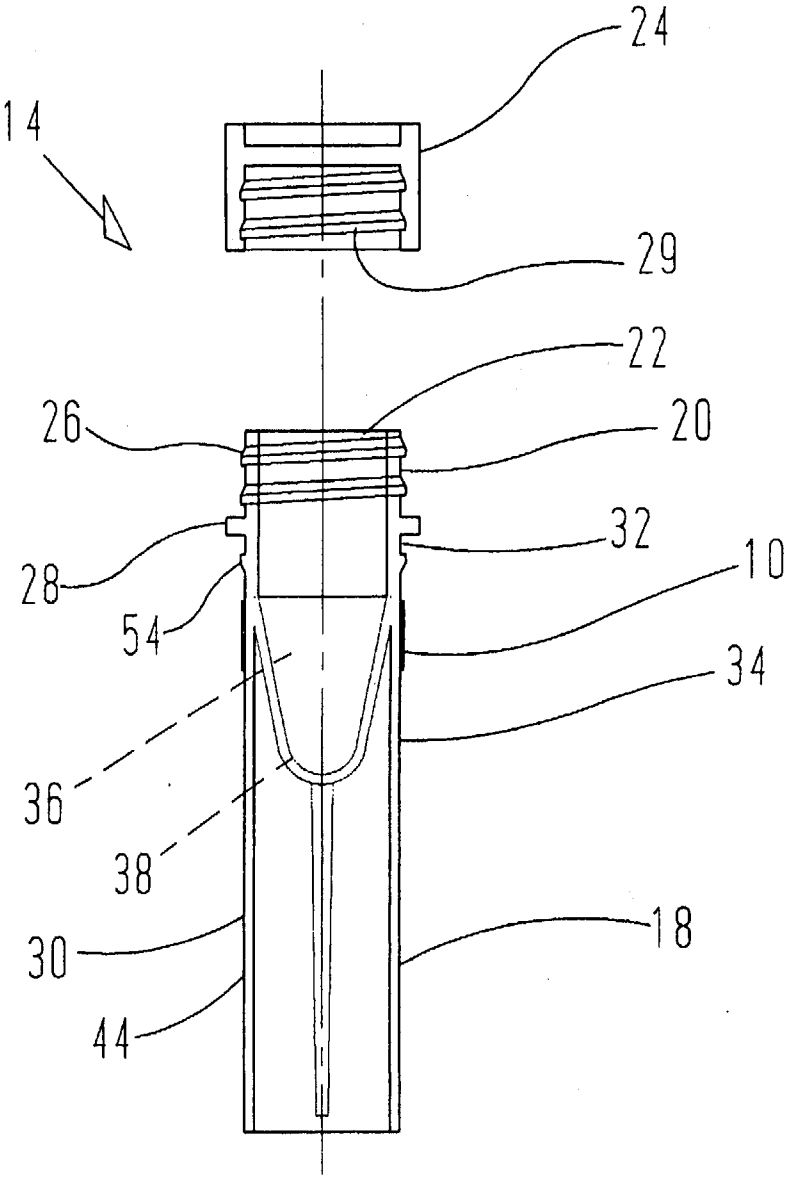

CRYOGENIC SPECIMEN CONTAINER AND LABELED SLEEVE COMBINATION AND METHOD OF USING SAME

BACKGROUND OF THE INVENTION

1. Field of the Invention

The present invention relates generally to cryogenic specimen containers. More particularly, the invention pertains to a cryogenic specimen container and labeled sleeve combination and method of using same to label stored specimens while said specimens are maintained at temperatures of −80° C. or below.

2. Description of the Prior Art

Various forms of cryogenic specimen containers are known in the art. One commonly used form are known as centrifuge tubes, which are often formed of polypropylene to withstand g-forces up to 13,000×G and greater. The tubes are provided with a removable screw cap which is often equipped with a silicone O-ring to maintain its sealing properties at cryogenic temperatures often as low as −180° C.

While centrifuge tubes provide a sufficient means for storing blood serums, blood specimens and the like, these tubes once stored at a cryogenic temperature can become difficult to label for identification purposes. The importance of proper labeling for the identification of specimens is well known in the medical and scientific communities. To this end, various labeling and coding methods are known. For example, cap inserts can be provided in various colors use for in color-coding specimens by inserting the cap insert onto the screw cap of the centrifuge tube. Further, tubes can be imprinted with a white write-on space that allows a user to write thereupon.

While such prior art devices and techniques provide a means for labeling tubes, these devices and techniques fail to provide a means for labeling tubes which are maintained at a cryogenic temperature. Adhesive in the form of adhesive labels, as well as ink will not adhere to tubes at cryogenic temperatures. Further, cap inserts do not provide sufficient space to allow a user to provide necessary identification, such as in the form of a printed bar code.

As will be described in greater detail hereinafter, the method and combination of the present invention solves the aforementioned problems and employs a number of novel features that render it highly advantageous over the prior art.

SUMMARY OF THE INVENTION

Accordingly, it is an object of this invention to provide a method and structure for labeling and thereby tracking cryogenic specimen containers stored at cryogenic temperatures.

Another object of this invention is to provide a manner of utilizing labels carrying identification markings, such as bar code identification.

Still another object of this invention is to provide a method and structure which is easy to use, inexpensive to manufacture, and can be readily adapted for use with centrifuge tubes of the prior art.

To achieve the foregoing and other objectives, and in accordance with the purposes of the present invention a sleeve structure is provided for use with a cryogenic specimen container which is maintained at a cryogenic temperature below approximately −50° C. to allow for labeling of the specimen container. The sleeve structure includes sidewalls defining a cylindrically shaped interior chamber sized for telescopically receiving a lower portion of a cryogenic specimen container in nested engagement. The sleeve structure has a locking mechanism for holding the sleeve structure in removably secured engagement with specimen container when the specimen container is in nested engagement with the sleeve structure.

In accordance with a method of the invention, a method of tracking specimen samples being stored at cryogenic temperatures is provided. The method includes the following steps: providing a cryogenic specimen container adapted for storing a specimen sample therewithin; providing a sleeve structure having sidewalls defining an interior chamber therewithin sized for telescopically receiving a lower portion of the specimen container; labeling the sleeve structure with identification markings; and releasably connecting the sleeve structure to the cryogenic specimen container by telescopically inserting a lower portion of the specimen container into the interior chamber for engagement therewith.

Other objects, features and advantages of the invention will become more readily apparent upon reference to the following description when taken in conjunction with the accompanying drawings, which drawings illustrate several embodiments of the invention.

BRIEF DESCRIPTION OF THE DRAWINGS

In the drawings:

FIG. 2 is a sectional exploded view of the present invention taken along line 2—2 of FIG. 1;

DETAILED DESCRIPTION OF THE PREFERRED EMBODIMENT

Figure 1:
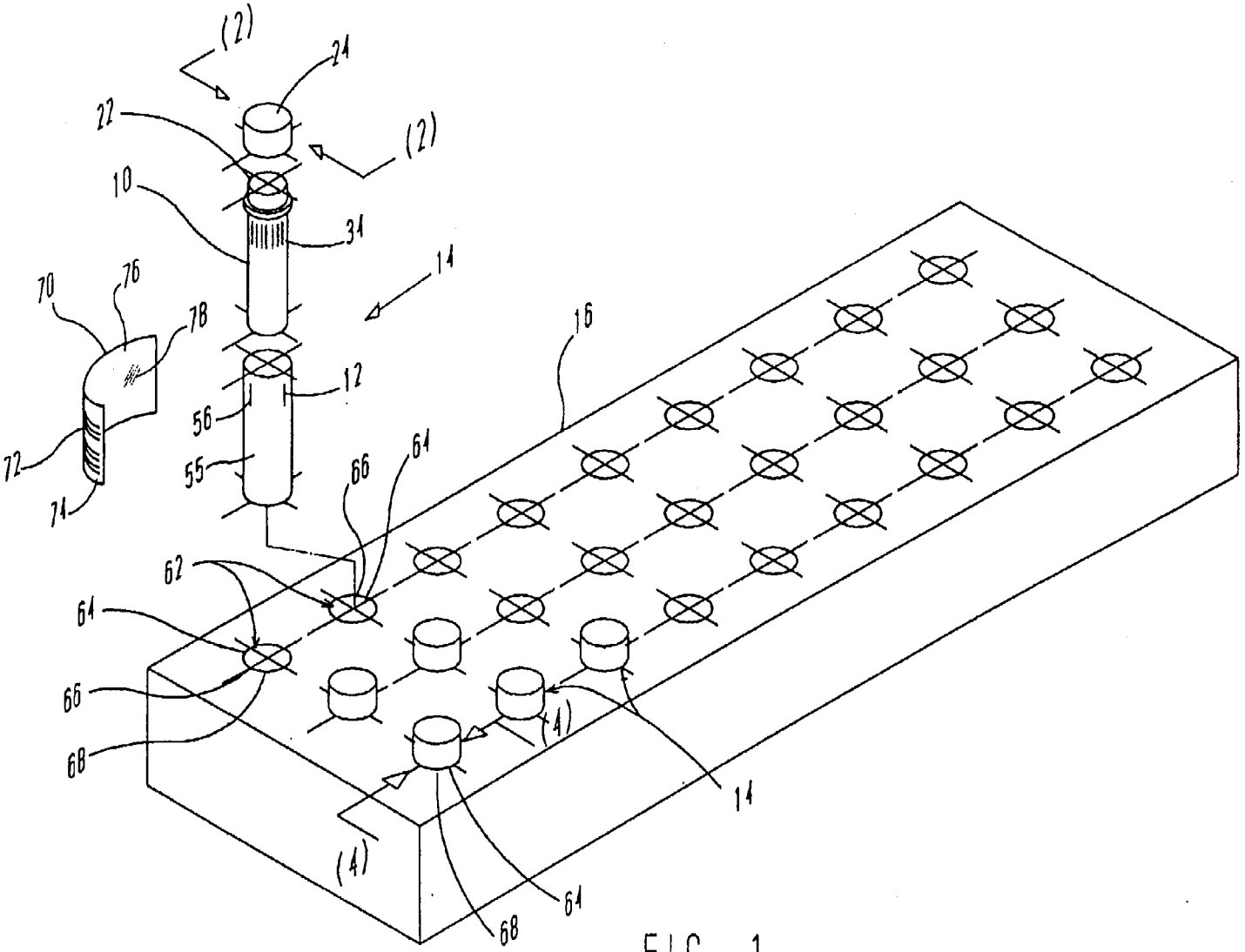
FIG. 1 is a perspective view of the cryogenic specimen container and sleeve combination shown in exploded view for nested engagement with a holder.

Referring now to the drawings, FIG. 1 illustrates in exploded view a combination of a cryogenic specimen container 10 and sleeve structure or apparatus 12. The combination, indicated by the numeral 14, may be held in storage holder or tray 16, as later described, which is adapted to hold a plurality of combinations 14 for secured storage and to facilitate easy transportation.

Referring to FIG. 2, the cryogenic specimen container 10 has a cylindrically shaped tubular body 18. The tubular body 18 has an upper portion 20 defining an aperture 22. The upper portion 20 is adapted for receiving a cap 24. Preferably, the upper portion 20 has external threads 26 for threaded engagement with internal threads 29 of the cap 24. The upper portion 20 of the tubular body 18 has an outwardly extending flange 28 extending about a circumferential exterior surface 30 of the specimen container 10. The body 18 also defines an interior chamber 36 sized for holding a specimen sample 38. The upper portion 20 has an annular grove 32 extending about the circumferential exterior surface 30 adjacent to the flange 28. A series of spaced apart vertically oriented ridges 34 extend about the exterior surface 30, as illustrated in FIGS. 1 and 2. It should be noted that the cryogenic specimen container 10 described herein is of the type known in the art as a centrifuge tube and accordingly the sleeve structure 12 and method disclosed may be implemented with existing tubes to provide an inexpensive and effective manner of solving the aforementioned problems of the prior art.

Figure 4:
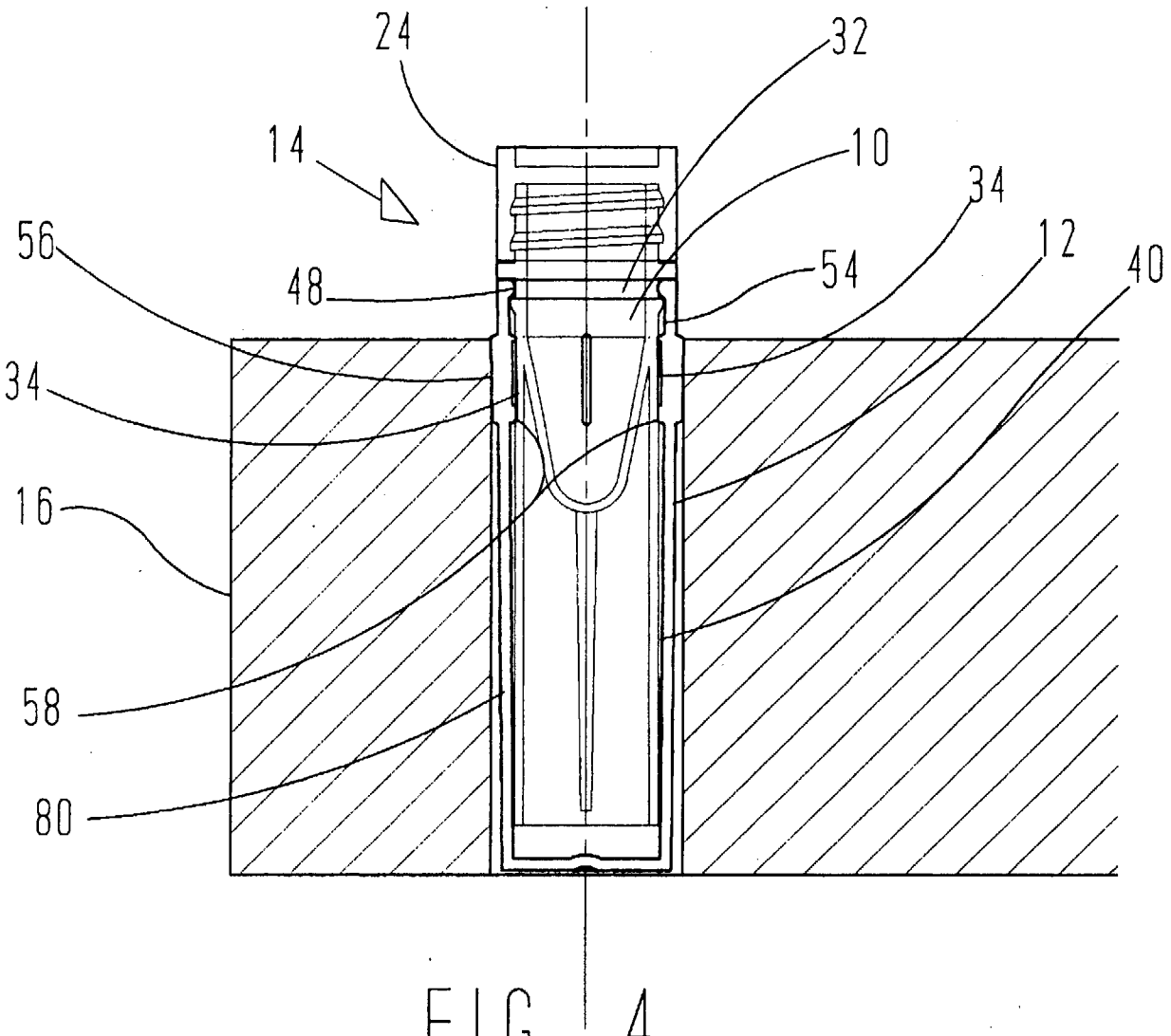
FIG. 4 is a sectional view of the present invention taken along line 4—4 of FIG. 1.

The sleeve structure 12 has sidewalls 40 defining a cylindrically shaped interior chamber 42 sized for telescopically receiving a lower portion 44 of the tubular body 18 in nested engagement, as illustrated in FIG. 4. The sleeve structure 12 has a locking portion 46 for releasably engaging the tubular body 18 to hold the sleeve structure 12 in removably secured engagement with tubular body 18 when the tubular body 18 is in nested engagement with the sleeve structure 12. Preferably, the sleeve structure 12 is formed of synthetic plastic, such as polypropylene, which is designed to withstand cryogenic temperatures of −80° C. or more without cracking or deforming.

Preferably, the locking portion 46 includes an interior annular ridge 48 extending about an upper edge 50 of the sidewalls 40 on an interior side 52. The interior annular ridge 48 is releasably engageable with the annular grove 32, as illustrated in FIG. 4. The upper portion 20 of the tubular body 18 has an exterior annular ridge 54. The exterior annular ridge 54 and flange 28 are positioned on opposite sides of the annular grove 32. Accordingly, interior annular ridge 48 is flexibly or resiliently movable over the exterior annular ridge 54 to provide snap fit engagement of the interior annular ridge 54 within the annular grove 32 when the tubular body 18 is moved telescopically within the sleeve structure 12 for nested engagement therewith.

Figure 3:
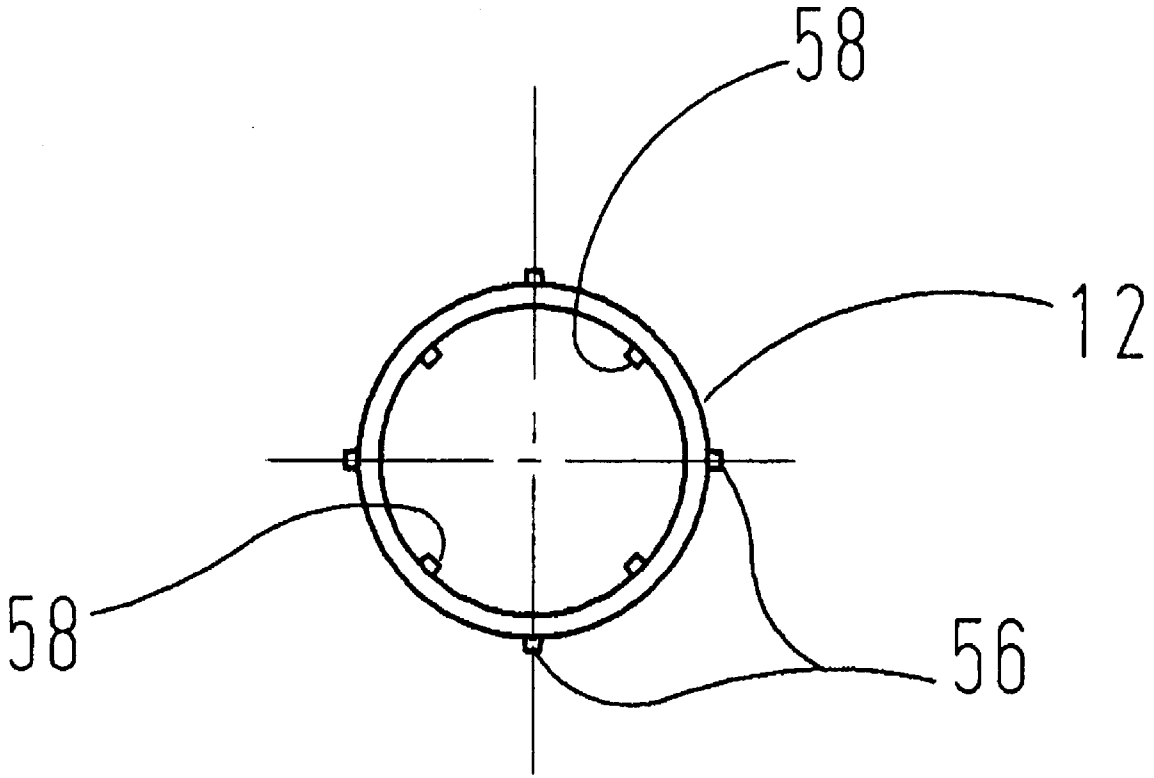
FIG. 3 is a top view of the sleeve structure of the present invention.

Referring to FIGS. 2–4, an outer surface 55 of the sleeve structure 12 has a plurality of spaced apart vertically oriented ridges 56 and the interior side 52 of the sidewalls 40 of the sleeve structure 12 has a plurality of spaced apart vertically oriented ridges 58. The ridges 56,58 are disposed on an upper portion 60 of the sleeve structure 12 below the interior annular ridge 48. The ridges 56 provide locking engagement of the combination 14 when the combination 14 is inserted into a receiving aperture 62 of the tray 16. Upper edges 64 extending about an opening 66 of the aperture 62 preferably contain a plurality of small ridges 68 which produce a locking type action when the ridges 56 are in pressing engagement thereagainst or between.

The plurality of spaced apart vertically oriented ridges 58 on the interior side 52 of the sidewalls 40 are in pressing engagement against the circumferential exterior surface 30 of the specimen container 10 when the specimen container 10 and sleeve structure 12 are in engagement with one another. The ridges 58 are in pressing engagement between the ridges 34 (FIG. 4) to prevent twisting or turning of the sleeve structure 12 on the container 10. Further, when the specimen container 10 and sleeve structure 12 are engaged, the tubular body 18 and sidewalls 40 are spaced apart to define a gap 80 therebetween, as best illustrated in FIG. 4.

A label 70 has identification markings 72, such as a bar code, printed on a first side 74 of the label. A second side 76 of the label 70 has an adhesive layer 78 secured thereto for adhesively securing the label 70 to the outer surface 55 of the sleeve structure 12. Alternatively, the outer surface 55 could be imprinted with a write-on space. In use, the label 70 can be printed and secured to the sleeve structure 12 while at room temperature. The sleeve structure 12 is then attached to the specimen container 10 which will already typically have a sample 38 contained within and is being stored or otherwise maintained at a cryogenic temperature, such as between −80° to −198° C.

According to a method of tracking specimen samples being stored at cryogenic temperatures, the method includes the following steps: providing a cryogenic specimen container 10 adapted for storing a specimen sample 38 therewithin; providing a sleeve structure 12 sized for telescopically receiving a lower portion of the specimen container 10; labeling the sleeve structure 12 with identification markings 72; and releasably connecting the sleeve structure 12 to the cryogenic specimen container 10. The step of providing a cryogenic specimen container 10 includes the step of storing a specimen sample 38 therewithin and maintaining the specimen sample 38 at a cryogenic temperature by placing the container 10 in a suitable freezing unit.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A combination of a cryogenic specimen container and sleeve structure comprising: said cryogenic specimen container having a cylindrically shaped tubular body, the tubular body having an upper portion defining an aperture, the upper portion being adapted for receiving a cap thereon, said sleeve structure having sidewalls defining a cylindrically shaped interior chamber therewithin sized for telescopically receiving a lower portion of the tubular body in nested engagement, said sleeve structure having locking means releasably engaging the tubular body for holding the sleeve structure in removably secured engagement with the tubular body when the tubular body is in nested engagement with the sleeve structure.

2. The combination of claim 1, wherein the sleeve structure includes means for labeling the sleeve structure with identification markings.

3. The combination of claim 2, wherein the labeling means includes a label having identification markings printed thereon, the label being secured to an outer surface of the sleeve structure.

4. The combination of claim 1, wherein the upper portion of the tubular body has a flange extending about a circumferential exterior surface of the specimen container, the upper portion having an annular grove extending about the circumferential exterior surface adjacent to the flange, said locking means including an interior annular ridge extending about an upper edge of the sidewalls on an interior side of the sidewalls, the interior annular ridge being releasably engageable with the annular grove.

5. The combination of claim 4, wherein the upper portion of the tubular body has an exterior annular ridge, the exterior annular ridge and flange being positioned on opposite sides of the annular grove, interior annular ridge being movable over the exterior annular ridge to provide snap fit engagement of the interior annular ridge within the annular grove when the tubular body is moved telescopically with sleeve structure for nested engagement therewith.

6. The combination of claim 4, wherein the outer surface of the sleeve structure has a plurality of spaced apart vertically oriented ridges and the interior side of the sidewalls of the sleeve structure has a plurality of spaced apart vertically oriented ridges, said ridges being disposed on an upper portion of the sleeve structure.

7. The combination of claim 4, wherein the plurality of spaced apart vertically oriented ridges on the interior side of the sidewalls of the sleeve structure are in pressing engagement against the circumferential exterior surface of the specimen container when the specimen container and sleeve structure are in engagement with one another.

8. A sleeve structure for use with a cryogenic specimen container maintained at a cryogenic temperature of −80° C.

or below to allow for labeling of said specimen container, said sleeve structure comprising: sidewalls defining a cylindrically shaped interior chamber therewithin sized for telescopically receiving a lower portion of a cryogenic specimen container in nested engagement, and locking means releasably engaging the specimen container for holding the sleeve structure in removably secured engagement with the specimen container when the specimen container is in nested engagement with the sleeve structure, the sleeve structure being formed of material adapted for use at cryogenic temperatures below −80° C.

9. The sleeve structure of claim 8, further comprising means for labeling the sleeve structure with identification markings.

10. The sleeve structure of claim 9, wherein the labeling means includes a label having identification markings printed thereon, the label being secured to an outer surface of the sleeve structure.

11. The sleeve structure of claim 9, wherein said locking means includes an interior annular ridge extending about an upper edge of the sidewalls on an interior side of the sidewalls, the specimen container having an annular grove extending about a circumferential exterior surface, the interior annular ridge being releasably engageable with the annular grove.

12. The sleeve structure of claim 11, wherein the interior annular ridge is in snap fit engagement within the annular grove when the tubular body is moved telescopically with sleeve structure for nested engagement therewith.

13. The sleeve structure of claim 11, wherein an outer surface of the sleeve structure has a plurality of spaced apart vertically oriented ridges and the interior side of the sidewalls of the sleeve structure has a plurality of spaced apart vertically oriented ridges, said ridges being disposed on an upper portion of the sleeve structure.

14. A method for labeling a cryogenic specimen container maintained at a cryogenic temperature of below −50° C., the method comprising the steps of:

(a) providing a cryogenic specimen container adapted for storing a specimen sample therewithin;

(b) providing a sleeve structure having sidewalls defining an interior chamber therewithin sized for telescopically receiving a lower portion of the specimen container, the sleeve structure carrying identification markings; and (c) releasably connecting the sleeve structure to the cryogenic specimen container by telescopically inserting a lower portion of the specimen container into the interior chamber for engagement therewith.

15. The method of claim 14, wherein the step of providing a cryogenic specimen container comprises the step of providing a cyclindrically shaped centrifuge tube.

16. The method of claim 14, wherein the step of providing a sleeve structure includes the step of printing identification markings on a label and securing the label to an outer surface of the sleeve structure where the sleeve structure is maintained at approximately room temperature.

17. A method of tracking specimen samples being stored at cryogenic temperatures, the method comprising the steps of:

(a) providing a cryogenic specimen container adapted for storing a specimen sample therewithin;

(b) providing a sleeve structure having sidewalls defining an interior chamber therewithin sized for telescopically receiving a lower portion of the specimen container;

(c) labeling the sleeve structure with identification markings; and (d) releasably connecting the sleeve structure to the cryogenic specimen container by telescopically inserting a lower portion of the specimen container into the interior chamber for engagement therewith.

18. The method of claim 17, wherein the step of providing a cryogenic specimen container comprises the step of providing a cyclindrically shaped centrifuge tube.

19. The method of claim 17, wherein the step of providing a cryogenic specimen container includes the step of storing a specimen sample therewithin and maintaining the specimen sample at a cryogenic temperature.

20. The method of claim 17, wherein the step of labeling includes printing identification markings on a label and adhesively securing the label to the an outer surface of the sleeve structure.

* * * * *